United States Patent [19]

Halssig

[11] 4,449,457

[45] May 22, 1984

[54] SAFETY DEVICE FOR THE FUZES OF NONSPINNING OR SLOWLY SPINNING PROJECTILES

[75] Inventor: Andreas Halssig, Schramberg, Fed. Rep. of Germany

[73] Assignee: Gebruder Junghans GmbH, Schramberg, Fed. Rep. of Germany

[21] Appl. No.: 351,865

[22] Filed: Feb. 24, 1982

[30] Foreign Application Priority Data

Mar. 7, 1981 [DE] Fed. Rep. of Germany ..... 3108659

[51] Int. Cl.[3] ..... F42C 15/24

[52] U.S. Cl. ..... 102/251; 102/235; 102/244; 102/255

[58] Field of Search ..... 102/231, 232, 233, 235, 102/244, 246, 249, 251, 254, 255, 222

[56] References Cited

U.S. PATENT DOCUMENTS

| | | | |
|---|---|---|---|
| 3,901,156 | 8/1975 | Rognmo et al. | 102/251 X |
| 3,921,531 | 11/1975 | Morrow | 102/251 |
| 4,128,061 | 12/1978 | Kaiser | 102/249 |

FOREIGN PATENT DOCUMENTS 3015424 10/1981 Fed. Rep. of Germany .

*Primary Examiner*—David H. Brown

*Attorney, Agent, or Firm*—Burns, Doane, Swecker & Mathis

[57] ABSTRACT

A fuze is provided for projectiles of the nonspinning and slow spinning types which possess a rotor that carries a detonator, and a first safety device preventing the rotor from bringing the detonator to an active position. The first safety device is responsive to acceleration force when the projectile is fired, to release the rotor for at least limited rotation. A second safety device permits only limited rotation of the rotor unless released. Release of the second safety device occurs in response to retardation of the fired projectile after the latter leaves the barrel and encounters air resistance. Release of the second safety device is possible only after a predetermined amount of rotation of the rotor when a locking bolt of the second safety device becomes aligned with an orifice in a stationary frame that mounts the rotor. The bolt whose mass is tuned to the retardation characteristics of the projectile, then travels through the orifice in the direction of acceleration to release the rotor for final travel.

5 Claims, 5 Drawing Figures

SAFETY DEVICE FOR THE FUZES OF NONSPINNING OR SLOWLY SPINNING PROJECTILES

BACKGROUND AND OBJECTS OF THE INVENTION

The invention concerns a safety device for the fuzes of nonspinning or slowly spinning projectiles of the type which contain a safety bolt which is responsive to acceleration forces to release a rotor for travel.

A safety device for nonspinning or slowly spinning projectiles is known which comprises two recoil bolts secured in their safety position by a ball. If one of the safety elements is missing, for example one of the recoil bolts, the rotor is arrested by means of a spring loaded, radially pivoting latch in its safety position. This, however, is inadequate from a safety standpoint, since a spring loaded latch may be released from its anchoring with the rotor by transport impacts or the like.

It is, therefore, an object of the invention to provide a safety system for the fuze of a non-spinning or slowly spinning projectile which will permit activation of the fuze in the case of a correctly installed safety system, but prevent such activation of the fuze in the case of faultily mounted safety systems.

SUMMARY OF THE INVENTION

The objects of the invention are attained by means of a bolt carried by the rotor and including a base on its lower side, the bolt being arranged for movement in the direction of acceleration of the projectile. Stop means on the frame includes a collar overlying the base when the bolt is in a locking position, to prevent movement of the bolt in the direction of acceleration. The stop means permits rotation of the rotor and bolt within a limited safety range. An orifice is provided in a frame which mounts the rotor. This orifice permits passage of the base past the collar in the direction of acceleration after a predetermined amount of rotation of the rotor has occurred. Such an arrangement is employed in conjunction with an acceleration-responsive safety device which releases the rotor for at least limited rotation in response to the acceleration forces which occur when the projectile is fired. The aforementioned safety bolt does not release in response to acceleration, but rather travels in the direction of acceleration in response in retardation of the projectile which occurs when the fired projectile encounters air resistance upon leaving the barrel.

The advantage here consists of the fact that by means of a simple design, the rotor is immobilized in its safety position even if the translation or pulse safety device is operating incorrectly or if parts of the pulse safety device are mistakenly omitted. The positively acting safety device prevents activation in the safety position. The fuze of a dud may be deactivated in a simple manner. In the case of a correctly operating safety device the safety elements work almost without friction. There are no transverse forces acting on the activating element during the activation process.

Preferably, a spring yieldably biases the bolt opposite the direction of acceleration. This minimizes the amount of friction occurring between the base of the bolt and the collar. This makes it possible to coordinate the point in time when, in the case of a correctly mounted and operating pulse safety device, the bolt securing the rotor releases the latter.

THE DRAWING

An example of embodiment of the invention is shown in the drawing, wherein.

DETAILED DESCRIPTION OF A PREFERRED EMBODIMENT OF THE INVENTION

Figure 1:
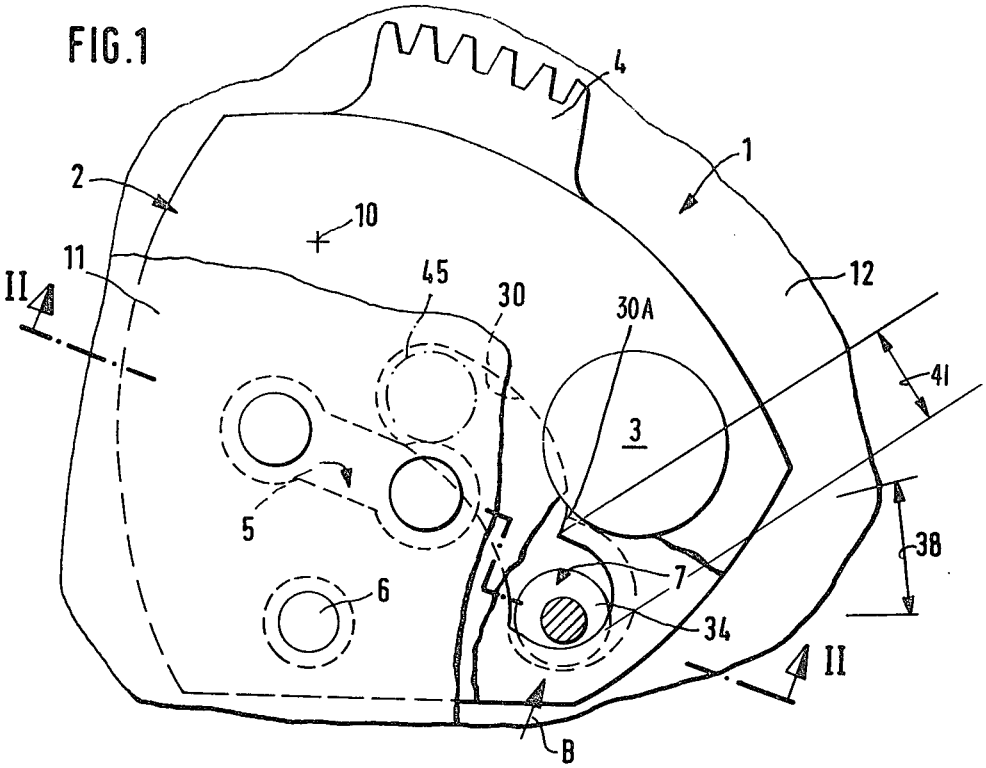
FIG. 1 shows a section of a base fuze.

According to FIG. 1, a base fuze 1 includes a rotor 2 rotatable about a pivot pin 6 by a clock mechanism (not shown) which includes an escapement. A detonator 3, a toothed segment 4, a pulse safety assembly 5, and a safety device 7 are carried by the rotor. The rotor 2 is in the "safe" position (FIGS. 1–3) until the rotor is rotated to such an extent that the detonator 3 reaches a location 10 where it is subject to detonation upon impact of the projectile.

Figure 2:
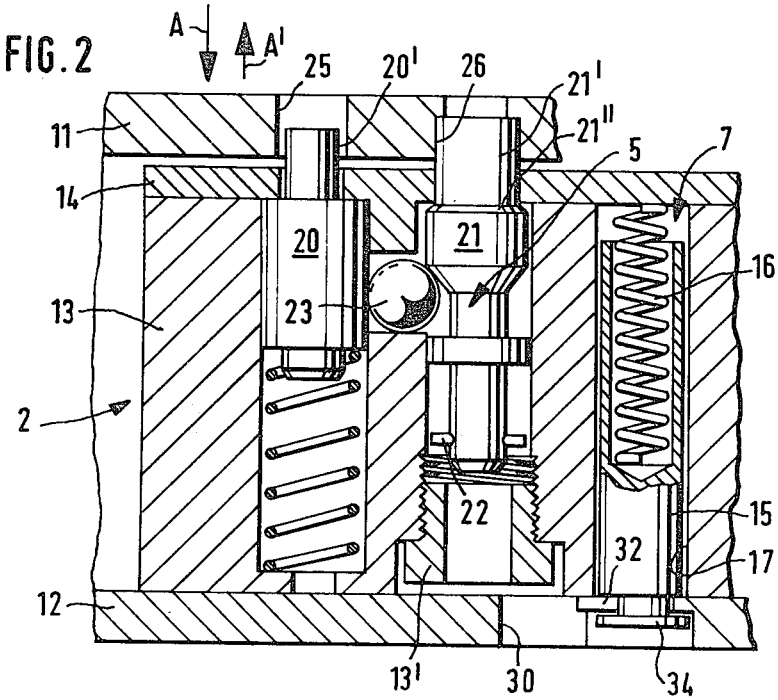
FIG. 2 shows a fuze according to FIG. 1 corresponding to the cross-section taken along line II—II in FIG. 1.

As depicted in FIGS. 1 and 2, the swivel pin 6 supports the rotor 2 between a frame comprised of a pair of plates 11 and 12 in a conventional manner not shown in detai. The rotor includes a housing 13 and a cover 14. The safety device 7 includes a bolt 15, a helical compression spring 16 and a bore 17 provided in the housing 13. The pulse safety assembly 5 is conventional and comprises bolts 20, 21, the latter having a shear pin 22, and a ball 23, all housed within the housing 13. The bolts 20, 21 respectively engage bores 25, 26 of the plate 11. The operation of the pulse safety assembly 5 is conventional and is explained later herein.

Figure 3:
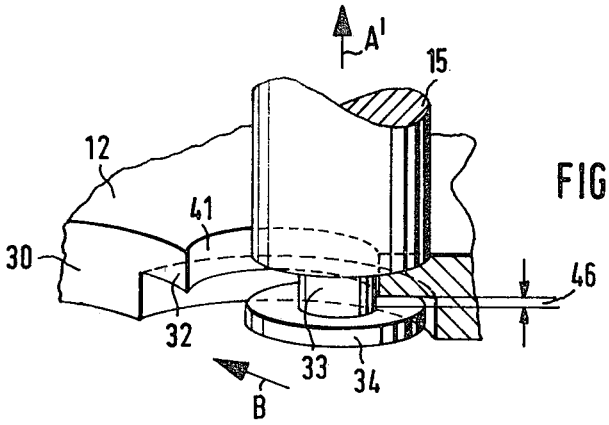
FIG. 3 is an enlarged fragmentary view of a safety element according to FIG. 1 in the transport position.
Figure 4:
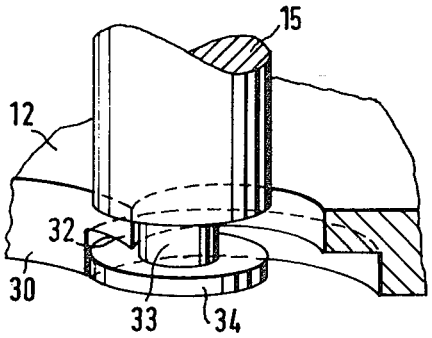
FIG. 4 is a view similar to FIG. 3 in the permanently "safe" position in the case of a faulty pulse safety device.

In relation to the safety device 7, according to FIGS. 2 and 3, a recess 30 and an overhanging collar 32 are provided in the plate 12. A groove 33 of the bolt 15 receives the collar 32 so that the collar 32 overlies a base 34 of the bolt 15. Thus, as can be seen in FIG. 3, the collar 32 locks the bolt 15 in the axial direction. Impacts during transportation acting in the direction of the arrows A, A' are arrested by the collar 32.

Lateral impacts acting in the radial direction B are ineffective even in the case of a missing pulse safety device 5, because the base 34 is always secured positively by the overlapping collar 32 (see also FIG. 1). This arrangement also protects against a possible error in the assembly of the clock mechanism, for example if the clock mechanism, because of missing parts, has no inhibiting action on the movement of the rotor.

Thus, if the pulse safety 5 is absent, the fuze 1 remains inactive, because the base 34 of the bolt 15 engages the collar 32 and remains so. That is, even if the rotor initiates its rotation, the base is unable to travel past a stop 30A in the recess 30 and rotation is halted after the rotor travels within a safety range 38. At this point the base 34 is again located under the collar 32 which surrounds the recess 30 in the direction of arrow B. During this travel, the base 34 passes under an orifice 41 of the recess 30, which orifice is slightly larger than the base 34. However, the base will only pass upwardly through the orifice 41 during normal firing conditions, as will be explained subsequently. Unless the base does pass upwardly through the orifice 41, as it travels within the recess 30, the fuze is rendered permanently inactive, i.e., the detonator 3 will not be able to ignite the transfer charge (not shown).

The present invention makes use of so-called "retardantion" occurring after the initial acceleration of the projectile and after the projectile leaves the barrel and encounters resistance in the ambient air. Thus, in accordance with the invention, the acceleration forces reacting against the fuze at the instant of firing serve to release the pulse safety assembly 5 and initiate movement of the rotor, and the subsequent retardation of the projectile serves to release the safety device 7 and thereby permit the rotor to travel to the active position (i.e., where the detonator 3 reaches position 10).

Figure 5:
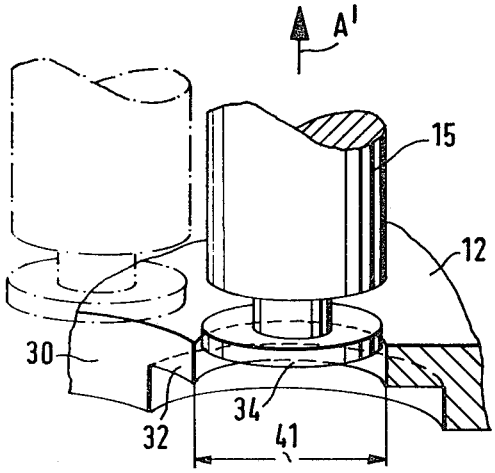
FIG. 5 is a view similar to FIG. 3 depicting the safety bolt 15 as it releases the rotor for final movement in the case of a properly installed and operating safety system.

Accordingly, if the assembly and operation of the fuze are correct, the pulse safety device 5 initially activates the rotor 2 in response to firing and accompanying acceleration. That is, acceleration causes the bolt 20 to be displaced in the direction of the arrow A until the ball 23 can be pushed against the peg 20' by the bolt 21 as the bolt 21 itself slides in the direction of the arrow A. The shear pin 22 is sheared-off in the process by the bushing 13', whereafter the neck 21' disengages from the bore 26 of the plate 11. The clock mechanism is unlocked upon the emergence of the neck 21' from the bore 26 so that the rotor 2 rotates in the direction of the arrow B. The bolt 21 continues to slide in the direction of the arrow A, until the ball 23 abuts against the neck 21'', thereby locking the pulse safety assembly 5. The clock mechanism (not shown) rotates the rotor 2 at a rate controlled by a conventional escapement and in the direction of the arrow B, until the base 34 reaches an underlying relation with the orifice 41. The parts are arranged such that if the fuze has functioned properly to this point, the projectile will encounter retardation just as the base 34 reaches the orifice 41. The mass of the bolt 15 is designed so as to be tuned with the retardation forces acting on the projectile in question and thus the bolt 15 moves in the direction of the arrow A'. Accordingly, the base emerges without friction from the orifice 41 of the plate 12 (FIG. 5) and eventually occupies a terminal position 45 indicated by the broken line in FIG. 1, as the rotor continues to rotate. When the base 34 is in position 45, the detonator 3 will be in its active position 10.

The spring 16 on the bolt 15 functions, in case of impacts during transportation, of retaining the base 34 on the collar 32. It further insures that by making the groove 33 large enough, a gap 46 is maintained between the base 33 and collar 32, to essentially eliminate friction between those components. Also, the spring aids in resisting passage of the base 34 through the orifice 41 except in cases where proper acceleration/retardation forces act upon the projectile.

The proper operation of the safety device is assured, however, even without the spring 16; the decisive condition is the positive locking of the bolt 15 on the plate 12 and the mass of the bolt 15 being tuned to the retardation of the projectile.

Thus, the base 34 can only leave the recess 30 after the pulse safety assembly 5 has been released, and even then only when proper retardation occurs at the precise instant when the base 34 becomes aligned with the orifice 41. In the case of a correctly installed and satisfactorily operating pulse safety device 5 and safety mechanism 7, two physical criteria, i.e., acceleration and retardation, must take place within a very precise and limited time interval (within a millisecond range), which can be reproduced only by the firing of a projectile containing the fuze. Duplication of such a sequence by handling of the projectile would be virtually impossible.

If projectiles with different retardation characteristics are involved, the safety mechanism 7 can be easily adapted to the prevailing projectile retardation by those skilled in the art.

Although the invention has been described in connection with a preferred embodiment thereof, it will be appreciated by those skilled in the art, that additions, modifications, substitutions, and deletions not specifically described, may be made without departing from the spirit and scope of the invention as defined in the appended claims.

I claim:

1. A safety arrangement in fuzes for projectiles of the nonspinning and slow spinning type, said safety arrangement being of the type including a frame, a rotatably driven rotor mounted on said frame and carrying a detonator, and first safety means for preventing rotation of said rotor to an active position and movable in response to acceleration of the projectile upon firing to release the rotor, the improvement comprising second safety means which includes:

a bolt carried by said rotor and including a base on its lower side, said bolt being arranged for movement in the direction of acceleration, stop means on said frame including a collar overlying said base when said second safety means is in a locking position, to prevent movement of said bolt in said direction of acceleration, said stop means permitting rotation of said rotor and bolt within a limited safety range, an orifice disposed in said frame and sized at least as large as said base and positioned to be in alignment with said base only after a predetermined amount of rotation of said rotor, to permit said base to travel past said collar in said direction of acceleration after said predetermined amount of rotation of said rotor.

2. Apparatus according to claim 1 including a spring yieldably biasing said bolt opposite the direction of acceleration said spring being weak enough to be overcome in response to retardation of said projectile.

3. Apparatus according to claim 1 wherein said orifice is arranged to become aligned with said base after said rotor has rotated partially through said safety range, said collar arranged to prevent movement of said bolt in said direction of acceleration in advance of and behind said orifice.

4. Apparatus according to claim 3, wherein said base defines a groove on said bolt, which groove receives said collar with clearance relative to said base.

5. A safety arrangement in fuzes for projectiles of the nonspinning and slow spinning type, said safety arrangement comprising:

a frame, a rotor carrying a detonator and mounted on said frame for movement to an active position wherein said detonator is adapted for activation, first safety means for preventing movement of said rotor to said active position, and being responsive to the forces of acceleration upon the firing of the projectile to release said rotor, and second safety means for preventing movement of said rotor to said active position even upon release of said rotor by said first safety means, said second safety means being responsive to retardation of the projectile after firing has occurred, to release said rotor for travel to said active position, said second safety means comprising:

a bolt arranged relative to stop means on said frame to permit limited travel of said rotor short of reaching said active position, said bolt being movable in the direction of acceleration to release said rotor, said bolt including a base at its lower end, a collar disposed on said frame in overlying relationship to said base to prevent movement of said bolt in said direction of acceleration when said second safety means is in a locking position, and an orifice disposed in said frame and sized at least as large as said base and positioned to be in alignment with said base only after a predetermined amount of travel of said rotor to permit said base to travel past said collar in said direction of acceleration in response to retardation of the projectile.

* * * * *